US005507888A

United States Patent [19]

Dickson, Jr. et al.

[11] Patent Number: 5,507,888

[45] Date of Patent: Apr. 16, 1996

[54] BICYCLE FRAMES AND ALUMINUM ALLOY TUBING THEREFOR AND METHODS FOR THEIR PRODUCTION

[75] Inventors: John A. Dickson, Jr., Wayne, Pa.; Thomas J. Klemp, Massena, N.Y.; Arvid H. Sorensen, Tempe, Ariz.; Robert L. Clottu, Laguna Hills, Calif.

[73] Assignee: Aluminum Company of America, Pittsburgh, Pa.

[21] Appl. No.: 152,549

[22] Filed: Nov. 15, 1993

Related U.S. Application Data

[63] Continuation-in-part of Ser. No. 32,927, Mar. 18, 1993, Pat. No. 5,342,459.

[51] Int. Cl.[6] ..... C22F 1/04

[52] U.S. Cl. ..... 148/690; 148/519; 148/697; 148/700; 148/415; 148/417; 148/437; 148/439

[58] Field of Search ..... 148/690, 697, 148/700, 415, 417, 437, 439, 519; 29/428, 700

[56] References Cited

U.S. PATENT DOCUMENTS

| | | | |
|---|---|---|---|
| 2,614,053 | 10/1952 | Bobb et al. | 148/690 |
| 3,133,796 | 5/1964 | Craig, Jr. | 428/654 |
| 3,306,787 | 2/1967 | Dies | 148/439 |
| 3,418,177 | 12/1968 | Pryor | 148/689 |
| 3,563,815 | 2/1971 | Meier et al. | 148/692 |
| 3,594,133 | 7/1971 | Cote et al. | 428/687 |
| 3,645,804 | 2/1972 | Ponchel | 148/502 |
| 3,762,962 | 10/1973 | Nilsson | 148/689 |
| 3,879,194 | 4/1975 | Morris et al. | 420/535 |
| 3,935,007 | 1/1976 | Baba et al. | 420/535 |
| 3,945,861 | 3/1976 | Anderson et al. | 148/690 |
| 4,000,007 | 12/1976 | Develay et al. | 148/523 |
| 4,042,424 | 8/1977 | Nicoud | 148/690 |
| 4,082,578 | 4/1978 | Evancho et al. | 148/535 |
| 4,113,472 | 9/1978 | Fister, Jr. et al. | 420/535 |
| 4,256,488 | 3/1981 | Livak | 420/534 |
| 4,589,932 | 5/1986 | Park | 148/690 |

OTHER PUBLICATIONS

"A New Alloy for Use in Body Parts for Motor Vehicles", by M. Buratti et al, *Alluminio,* vol 47, No. 10, pp. 372–374.

*Primary Examiner*—David A. Simmons
*Assistant Examiner*—Robert R. Koehler
*Attorney, Agent, or Firm*—Carl R. Lippert

[57] ABSTRACT

Methods for making an aluminum alloy bicycle frame and for making tubes for such frames including use of an aluminum alloy containing about 0.5 to 1.3% magnesium, about 0.4 to 1.2% silicon, and about 0.6 to 1.2% copper and preferred practices for making extruded and drawn tubing of the alloy and making bicycle frames from the tubing. The preferred practices include extrusion temperature control and other aspects of extrusion and drawing.

51 Claims, 1 Drawing Sheet

BICYCLE FRAMES AND ALUMINUM ALLOY TUBING THEREFOR AND METHODS FOR THEIR PRODUCTION

This application is a continuation-in-part of U.S. application Ser. No. 08/032,927, filed Mar. 18, 1993, now U.S. Pat. No. 5,342,459, the entire content of which is incorporated herein by reference.

This invention relates to improved bicycle frames and subframes comprising aluminum alloy tubular members and to improved methods for providing said bicycle frames and the improved aluminum tubular members used for making the frames.

BACKGROUND

Aluminum is known to be used in bicycle frames because of its light weight and good strength properties. In general, a bicycle frame is made by joining several tube-type members together which can be by tube and socket joining or, in modern bicycle frames, by welding. The frames can also be assembled by adhesive or other bonding or by combinations of these and other joining techniques. In general, aluminum frames have larger diameter tubes with thinner walls than tubes for steel frames. Aluminum alloys offer obvious advantages in high performance or racing bicycles and have been used in those applications for a number of years. In addition, aluminum frames have some flex which can be advantageous for impact and shock resistance. Some bicycles can be of a single permanent rigid frame or they can have a main or core frame plus subframe parts or assemblies especially where the bicycle includes moving suspension members.

Aluminum alloy 5086-H32 has been used in bicycle frames for a number of years. Alloy 5086 is a non-heat treatable alloy that has a relatively high ultimate tensile (breaking) strength which is important in a bicycle frame, but suffered a reduction in its yield strength in the heat affected zones adjacent weldments. Despite this low to modest yield strength disadvantage, it was employed for a number of years because of its good ultimate strength. Alloy 5086, according to the Aluminum Association registration, the entire contents of which are incorporated herein by reference, contains 3.5 to 4.5% magnesium, 0.2 to 0.7%% manganese, 0.05 to 0.25% chromium, 0.4% maximum silicon, 0.5% maximum iron, 0.1% maximum copper, 0.25% maximum zinc, the balance aluminum and incidental elements and impurities.

Another aluminum alloy tube product that has been used in making bicycles is alloy 7005. This alloy is a heat treatable alloy and has good T6 temper strength, including good strength in heat affected zones adjacent welds provided the bicycle frame was heat treated and artificially aged after welding, so as to offer some advantage over the 5086-H32 product. However, alloy 7005 has a lower corrosion resistance and stress corrosion cracking resistance level than alloy 5086. Alloy 7005 could be provided as F temper or O temper tube with end regions thickened by butt forming and welded to make the bicycle frame which was then solution heat treated and air-quenched and artificially aged to good strength levels. Another practice could include starting with artificially aged T62 or T63 temper. Alloy 7005, according to Aluminum Association registration, contains 4 to 5% zinc, 0.2 to 0.7% manganese, 1 to 1.8% magnesium, 0.06 to 0.2% chromium, 0.08 to 0.2% zirconium, 0.01 to 0.06% titanium, maximum of 0.35% silicon, 0.4% maximum iron, 0.1% maximum copper, the balance aluminum and incidental elements and impurities.

Another aluminum alloy tube product that has been employed in bicycle frames is alloy 6061-T6. This alloy offered good strength, together with good corrosion resistance, and could have good strength properties in heat affected zones adjacent weldments provided the bicycle frame was re-heat treated after welding. This required solution heat treating the entire bicycle frame and quenching it which, in turn, typically distorted the frame such that it had to be straightened at some not insignificant cost. The frame was then artificially aged to T6 temper. Alloy 6061, according to Aluminum Association registration limits, contains 0.8 to 1.2% magnesium, 0.4 to 0.8% silicon, 0.15 to 0.4% copper, 0.04 to 0.35% chromium, 0.7% maximum iron, 0.15% maximum manganese, 0.25% maximum zinc, the balance aluminum and incidental elements and impurities.

Each of the above-mentioned alloys has found substantial use in making aluminum bicycle frames and each has served reasonably well for that purpose, but there is room for improvement.

SUMMARY OF THE INVENTION

In accordance with the invention, an aluminum alloy containing about 0.5 to 1.3% magnesium, about 0.4 to 1.2% silicon, about 0.6 to 1.2% copper, about 0.1 to 1% manganese, the balance substantially aluminum and incidental elements and impurities, is employed to make improved bicycle frames or bicycle frames at reduced cost (or both) over some of the other approaches described above. This alloy is heat treatable such that it can be solution heat treated, quenched and artificially aged to quite good T6 strength levels. The artificially aged (T6) strength properties of this alloy are quite adequate for bicycle frames, being significantly higher than alloy 6061-T6 in the aluminum alloy tube sections and possessing sufficient strength after welding such that, even without re-solution heat treating and quenching and artificial aging a welded frame, said alloy in the weld heat affected zone has strength levels which, while they can be lower than 6061 that has been resolution heat treated and artificially aged, are nonetheless useful in less critical bicycle applications. Thus, said alloy enables producing relatively strong bicycle frames without the need for the added cost of re-solution heat treating and artificial aging after welding the frame and without the cost of frame straightening procedures often attendant thereto.

In another embodiment of the invention, the alloy is provided in the solution heat treated and quenched temper (T4) without artificial aging. This alloy in T4 condition exhibits very good elongation, typically 23% or 25% or more, at around 20 or 25 ksi yield strength and over 43 ksi ultimate strength. These T4 properties are very amenable to end butting to thicken the ends for welding or other joining techniques, if desired, it usually being preferred to thicken the tube ends for welding especially in serious duty bicycles. After welding T4 tubing to make a bicycle frame, it can be artificially aged without intervening solution heat treating and quenching (and the associated distortion issues) to develop good strength properties, albeit slightly lower in weld heat affected zones than true T6 strengths, the yield strength nonetheless being higher than alloy 5086 at comparable ultimate or tensile strength. However, in a still more preferred embodiment from the standpoint of strength, the welded bicycle frame comprising the aforesaid improved bicycle tube stock is solution heat treated, quenched and artificially aged to achieve strength to weight factors very attractive to bicycle makers and users, considerably better strength to weight factors than 6061 or 7005 alloy frames, for instance. This embodiment can require some frame straightening which can be kept to acceptable levels, or possibly might even be eliminated, through careful heat treating or quenching, or both. Careful welding also can be a factor in reducing overall distortion effects which can be cumulative.

The following table illustrates the respective properties of 5086-H32, 6061-T6061-T8,7005-T62 and the invention tubing in terms of minimum or guaranteeable properties. The invention tubing properties are given for three tempers:

T4—solution heat treated, quenched and naturally aged to a stable strength level;

T6—solution heat treated, quenched and artificially aged;

T8—solution heat treated, quenched, cold worked and artificially aged.

| | | | | | Invention Alloy | | |
|---|---|---|---|---|---|---|---|
| | 5086-H32 | 6061-T6 | 6061-T8 | 7005-T62 | T4 | T8 | T6 |
| UTS, ksi | 40 | 42 | 44 | 50 | 40 | 54 | 52 |
| TYS, ksi | 28 | 35 | 40 | 44 | 20 | 48 | 47 |
| Elongation, % | 8 | 10 | — | 10 | 21 | 6 | 8 |
| Density, lbs/in$^3$ | 0.096 | 0.098 | 0.098 | 0.1 | 0.098 | 0.098 | 0.098 |
| Modulus, Msi | 10.4 | 10 | 10 | 10.3 | 10 | 10 | 10 |
| Specific UTS (UTS ÷ density) | 417 | 429 | 449 | 500 | 408 | 551 | 531 |

In corrosion and stress corrosion cracking resistance, the invention tubing along with 6061 and 5086 are good, whereas 7005-T62 is not as good.

The aforesaid alloy for bicycle tube stock according to the invention includes alloy 6013 which is described in U.S. Pat. No. 4,589,932, the entire contents of which are fully incorporated herein by reference. The Aluminum Association composition limits for alloy 6013 are 0.6 to 1% silicon, 0.8 to 1.2% magnesium, 0.6 to 1.1% copper, 0.2 to 0.8% manganese, 0.5% maximum iron, 0.1% maximum chromium, 0.25% maximum zinc, 0.1% maximum titanium, other elements 0.05% each, 0.15% total, the balance substantially aluminum. All composition limits herein are by weight.

Bicycle frames typically employ aluminum tubes about 1.4 or 1.5 to 2 inches outside diameter (O.D.), typically about 1.65 or 1.7 to about 1.8 or 1.85 inches, for instance about 1¾-inch nominal O.D. with a wall thickness of about 0.04 to about 0.1 inch, typically from about 0.05 to about 0.07 inch for the forward half of the frame with the O.D. about 0.7% or 0.8 inch to about 0.95 inch, typically around ⅞ inch O.D. for the rear frame parts.

In accordance with the invention, the improved bicycle stock is preferably made by an improved process including extruding and drawing to better facilitate consistent good strength properties including ultimate (breaking) tensile strength and yield strength, along with quite good elongation and quite good workability. This is attributed, at least in part, to achieving in the drawn tube product a relatively uniform or consistent recrystallized grain structure as described herein. If care is not exercised in producing the desired extruded and cold finished tube, large or relatively widely varying grain sizes can occur when the metal recrystallizes during heating such as during an anneal or a solution heat treatment. Such grains of large or relatively widely varying size can detract from strength properties by either lowering them or making them inconsistent from extrusion to extrusion or even along the length of a given extrusion, or combinations of these effects. It can be desired to have the tube unrecrystallized such that most, for instance 70% or more, or substantially all of the tube metal is unrecrystallized. However, in making cold drawn, or cold finished, tube, achieving a sufficiently unrecrystallized grain structure can be difficult in view of the substantial amounts of cold work used in producing the relatively thin-walled tubes. When subsequently annealed or solution heat treated, the cold worked tube can recrystallize but that can lead to small grains along with large grains. This mixed grain structure impairs consistent strength and corrosion resistance. If the extrusion stock (billets or castings used for extruding into extrusions) is relatively small, such as 6 to 8 or 9 inches diameter, or the resulting extrusion is quite thin, such as ⅛ or ¼ inch (or both), such can favor achieving finer relatively more uniform grain size than using larger commercial scale practices such as ingot or extrusion stock over 11 or 12 inches, such as 13-inch or 14-inch or 15-inch to 18 or 20 or 22-inch or larger diameter stock, and making extruded sections thicker than ¼ or ½ inch (for instance, above 1 inch thick) where, it has been found, the extrusion operation can lead to excessively large recrystallized grains later in the overall manufacturing process. Nonetheless, the invention is useful with billet sizes from 6 inches (or less) up to and over 14 or 15 inches diameter.

In accordance with the invention, it has been found that controlling the extrusion temperature as hereinbelow set forth can overcome the problem of excessive grain size or variation after solution heat treating or other elevated temperature exposures such as annealing. That is, extrusion temperatures of 850° or 1000° F. (as referred to in U.S. Pat. No. 4,589,932), especially temperatures over about 900° F. can be detrimental in making certain cold finished tube, whereas extruding at temperatures of 400° to 600° F. or 700° F. can be quite beneficial in producing certain products of more uniform or relatively fine recrystallized grain size, or both.

In accordance with the invention, the improved tubing is made by extruding under controlled conditions which is followed by drawing the extruded tube at substantially room temperature to cold work it and reduce its cross-sectional area which, in turn, is followed by solution heat treating, quenching and stretching in a typical sequence. The cold reductions by drawing can be in the area of 20 to 25% reduction per pass for overall reductions of about 20 or 30% up to about 60 or even 80% in typical productions.

BRIEF DESCRIPTION OF THE DRAWINGS

In the following detailed description, reference is made to drawings in which.

DETAILED DESCRIPTION

Figure 1A:
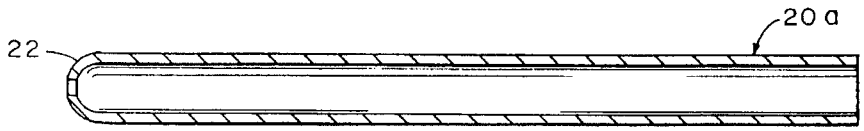
FIGS. 1*a* through e are elevation views in cross section showing the operation sequence in butt ending tube.

In accordance with the improved process, the alloy composition is formulated to contain about 0.5 to 1.3% magnesium, preferably about 0.7% or 0.8 to 1.1 or 1.2% magnesium, and about 0.4 to 1.2%, preferably about 0.6 to 0.9 or 1% silicon, and about 0.6 to 1.2%, preferably about 0.7% to 1% copper, and about 0.1 to 1%, preferably about 0.2 or 0.3 to 0.7% or 0.8% manganese, with iron preferably around 0.5% or less, for instance 0.35 or 0.4% or less, the balance substantially aluminum and incidental elements and impurities. Unless indicated otherwise, all composition percentages set forth herein are by weight. The alloy is typically solidified into ingot derived working stock by continuous casting or semi-continuous casting into a shape suitable for extrusion which is typically a round ingot billet. The ingot can be machined or scalped to remove surface imperfections, if desired, or it can be extruded without machining if the surface is suitable for such. The extrusion process produces a substantially reduced diameter but greatly increased length compared to the extrusion billet. Before extrusion, the metal is typically preheated or homogenized preferably by heating to a temperature above 950° F., for instance within 1000° to 1050° or 1060° F. or more, preferably within about 1030° or 1040° to about 1050° or 1060° or 1070° F. or possibly 1080° F or higher (although melting related damage which can occur at around 1075° F. should be avoided), for over one hour, more preferably about 4 hours or more, for instance 6 or 8 hours or more, such as 24 hours or more, preferably in a protective atmosphere.

After preheat or homogenizing, the stock is extruded to produce a hollow tube, it generally being recognized in the extrusion art that dies and other provisions can be made for extruding hollow shapes. The die-over-mandrel technique using a pre-drilled hollow extrusion stock or billet and the piercing process which pierces a solid extrusion stock or billet in the extrusion press are two known techniques suitable for making seamless hollow extrusions. Extrusion can be direct or indirect extrusion. It is an important preference in practicing the invention that extrusion be conducted at temperatures at or above 400° F., typically within about 500° or 600° up to about 700° F., preferably within about 500° or 550° or 660° to about 650° or possibly 675° F., for instance within temperatures of about 600° or 620° to about 650° F. Temperatures up to 750° or possibly 800° F. or even higher, such as temperatures of 850° or 875° or even possibly up to 890°, can be useful but on a less preferred basis. Extrusion rates of at least 75 feet per minute are preferred especially if the extrusion temperature is relatively high, for instance 750° F. or more, especially temperatures of 800° F. or more. The extrusion ratio (billet cross section metal area divided by extrusion cross section metal area) is desirably at least 5 to 1, typically about 5 to about 30 or more to 1, for instance about 8 or 10 to 25 or 27:1. Extrusion temperatures can be controlled by heating the extrusion stock and preferably also the extrusion chamber to the desired temperature. In accordance with the invention, it has been found that using extrusion temperatures and extrusion rates as just described can overcome a tendency to encounter excessively varying or large grain size when the material recrystallizes during subsequent heating such as solution heat treating. Extrusions made by indirect extrusion often can have larger grains in the immediate outer surface or "skin" region. In referring to grain size herein, such is intended to refer to the regions inside the skin regions in extrusions or products made from such.

Extrusion size can vary from around ⅞ or 1-inch outside diameter (O.D.) and around 0.075 or 0.09-inch wall thickness, up to as much as 4 or 5-inch O.D. and 0.25-inch wall thickness. The extrusion typically has ends cropped off and can be cut to desired lengths for subsequent operations. The extrusion may be annealed for around 1 or 2 hours at a temperature within about 600° to about 700°, for instance about 650° F., furnace cooled to about 450° upon which the tube can be removed from the furnace. Annealing at this point can be preferred but is not necessary. The annealing conditions the metal for subsequent drawing operations and can be advantageous especially where the drawing operations produce substantial reductions in thickness.

The tubing is next subjected to cold drawing wherein it is pulled through a die which reduces the outside diameter and the wall thickness. Normally there is a mandrel inside the tube during this drawing operation. This drawing significantly reduces the outside diameter and wall thickness and makes the tube significantly longer while slightly reducing the tube I.D. Each drawing operation or stage typically involves a single die and a reduction in metal cross-sectional area of about 10 or 12 or 15 to 30%, preferably about 18 or 20% to about 22 or 23 or 25%. Two or three such reductions or stages can be done, one after the other, to accumulate a substantial reduction, for instance 25 to 80% or more, but if total overall reductions exceeding 50% are desired, it can sometimes be advantageous to impose an intermediate anneal somewhere in the drawing schedule. For instance, two or three or possibly four drawing reductions can be made followed by an intermediate anneal followed, in turn, by two or three or four more drawing reduction passes. However, reductions in the neighborhood of 75% can be done without annealing.

Heating the tube, either during an intermediate anneal, if one is used, or during solution heat treatment typically can cause recrystallization to occur and the practice of the invention favors forming a relatively fine and relatively uniform recrystallized grain size when this recrystallization occurs. Typical transverse recrystallized grain sizes preferably can range from ASTM-2 or-3 to ASTM-7 or-8 (higher numbers are finer grains) referring to ASTM E112, the entire content of which is hereby incorporated by reference. Tube of the herein referred to alloy made identically to the invention process except for extrusion temperatures around 850° or 900° F. can have quite large transverse grain sizes such as ASTM-0 and can have relatively widely varying grain sizes.

The tube is solution heat treated, preferably in a protective atmosphere, by heating to temperatures typically at 1000° F. or higher, preferably at temperatures of 1025° or 1030° F. or higher, for instance temperatures of 1035° or 1040° or 1045° F. or 1050° F. or higher, up to temperatures of about 1065° or 1070, or possibly 1080° F. or more, but not so high as to excessively damage the tube such as by approaching too close to melting or incipient melting which can occur as low as 1075° F.

The solution heated tubing is then quenched, preferably by immersion in cold water, although cold water sprays or, in some cases, possibly even a drastic air quench could be used, it being preferable to assure a rapid quench. The quenched tube can then be stretched about ½ to 1½ to straighten it or, if desired, it can be further drawn by pulling through a die as described earlier. Solution heat treating and quenching, with or without a relatively small amount of cold work in straightening or flattening (that may not be recognized in setting mechanical property limits), produces a T4 type temper condition that can be used in making bicycle frames or other products. The T4 type condition is more ductile and easier to work with than the stronger artificially aged temper condition. For instance, with T4 tube it is easier to impart the thickened walls useful in the tube end regions. As explained elsewhere herein, using T4 tubing for making bicycle frames is an embodiment that can be preferred in some cases. Tube in T4 temper that has been solution heat treated at a relatively high temperature, such as 1030° F. or 1040° F. or more, can be used in welded bicycle frames that can then be re-solution heat treated at a lower temperature, such as 1000° F. or even less, such as 950° or 970° or 980° F., to reduce quench distortion, and then can be quenched in a modified (slower than cold water) quench to further reduce quench distortion.

The solution heat treated tube, with or without subsequent stretching or cold drawing, can be artificially aged to develop its strength properties. This typically includes heating above 250° or 270° F., typically above 300° F., for instance within about 330° or 340° or 350° to about 400° or 420° F. or 430° F. or a little more, preferably within about 360° to about 390° or possibly 400° F. for a period of time within around an hour or a little less or two hours to about 10 or 15 hours, typically about 3 or 4 to 5 or 6 hours for temperatures about 350° to 390° F., which generally varies inversely with temperature (higher temperature for less time or lower temperature for longer time) and this develops artificially aged or T6 or T8 strength, depending on whether or not and to what extent cold work is utilized after solution heat treating and before artificial aging. If the amount of cold work performed on the solution heat treated and quenched tube is around 1% or so, for instance, if the tube is only straightened and then artificially aged, the tube can be in a T6 type condition, whereas if a higher amount of cold work is used between solution heat treating and aging, for instance, drawing reductions around 4 or 5% or so to about 30% or so, the resulting tubing can be in a T8 type temper such as T81. These drawing operations (after solution heat treating) offer certain advantages in facilitating very good dimensional control. In addition, there can be a significant increase in strength such as an increase of 5% or 10% and possibly more. Tubing in these strong artificially aged tempers such as T6 or T8 can also be used in making bicycle frames. For instance, strong T8 tube can be used in making bonded frames, that is, frames where the tube members are bonded together by adhesives or the like.

Referring to the invention products, the invention tubing in T6 temper can have a relatively high strength roughly in the same ballpark as aerospace alloy 2024 in T3 temper (2024-T3 tube can have a yield strength around 42 ksi and a tensile strength over 60 ksi) but not have 2024's inferior stress corrosion cracking resistance, the invention product being quite resistant to stress corrosion cracking effects which can be a serious consideration in bicycle frames since an unexpected stress corrosion crack breakage during hard bicycle use would be undesirable product performance. The invention tubing also has good fracture toughness and good fatigue properties.

In manufacturing improved bicycle frames in accordance with the invention, the invention tubes are joined to each other or to other members by welding or other joining techniques, preferably welding. The front half of the frame is typically tubing about 1¾ inches in O.D. (referring to the frame from the seat or pedal yoke to the steering yoke), and the rearward part of the frame (for the rear wheel) is typically made from tubing about ⅞ inch in O.D. As indicated earlier, the good weldability of the improved tubing and its good as-welded strength can permit the bicycle frame to be used without subsequent or post-welding heat treatments and without the need to straighten the frame because of distortion that can be encountered in solution heat treating and quenching. This is of substantial benefit to the bicycle frame builder in cost savings and in producing a frame of quality. The superior strength of the invention tubing facilitates making thinner tube sections at certain parts of the bicycle frame, and this is a weight savings benefit.

Another embodiment of the invention produces still higher strength in that full heat treated and artificially aged strength properties can be achieved with the improved bicycle frame by solution heat treating, cooling and artificially aging the frame after welding. One preferred practice according to this embodiment includes using T4 temper tubing made according to the invention including a high solution heat treat temperature, for instance around 1010° or 1015° or 1020° to around 1075° or 1080° F., followed by a rapid cooling, e.g. cold water quench. This tube preferably has its ends thickened for joining, and after welding the bicycle frame together, the frame is solution heat treated at a relatively low temperature, that is typically 1000° F. or less such as within around possibly as low as 850° or 900° F. or more, preferably higher such as 950° F. or 970° F. up to 990° F. or 1000° F. or 1010° F or 1020° F, to reduce distortion in the subsequent quench. The hot bicycle frame is preferably rapidly cooled, such as quenching in water. However, in another embodiment the quench itself can also be controlled to reduce distortion of the bicycle frame such as by using means to retard or slightly retard the rate of cooling slightly such as by quenching in warm water, for instance water at a temperature within around 120° or 130° or possibly 140° to 160° or 170° or possibly 180° F., or by using chemical quench rate additives such as polyalkylene glycol in an amount of about 10 or 15% to about 30 or 40% in water at roughly room or slightly elevated temperature such as 90° to 110° F. Another quench approach is to use water containing $CO_2$, e.g. carbonated water. These procedures can lower residual stresses and thus reduce the amount of distortion to be corrected later. The strength loss, if any, that may result from the use of a retarded quench rate can be reduced or minimized by carefully controlling the quench conditions so as to quench at a slightly reduced rate but not a grossly reduced quench rate.

To make the bicycle frame or subframe, the tubes are cut or segmented into appropriate lengths and the end regions of the tubes are preferably made thicker. This can be accomplished by the known techniques referred to as "end butting" wherein the tube metal wall thickness is made significantly thicker in the end region (for instance, an inch or so of end region length) typically such that the tube O.D. is constant but the I.D. is smaller at the end regions. The tube metal thickening is preferably done after solution heat treating (T4 temper) but could be done in an annealed temper or work hardened temper (drawing work hardens the tube) before solution heat treating on a less preferred basis.

Figure 1B:
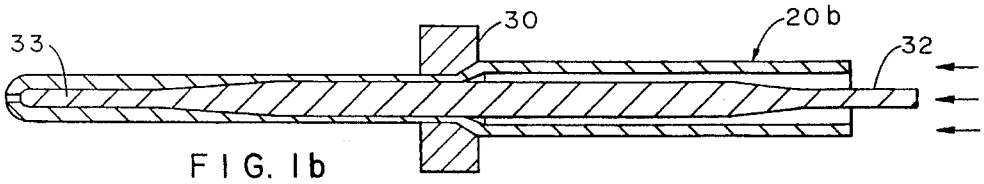
Figure 1C:
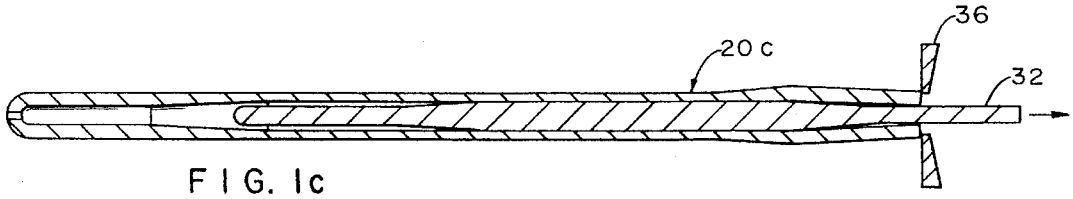
Figure 1D:
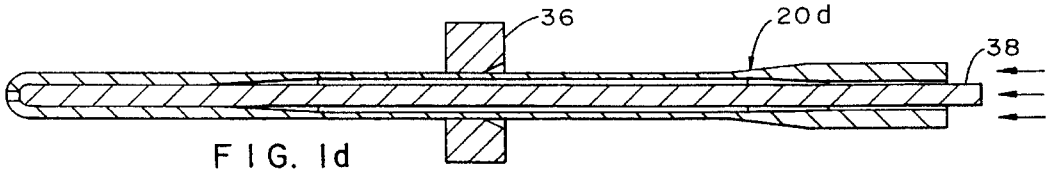
Figure 1E:
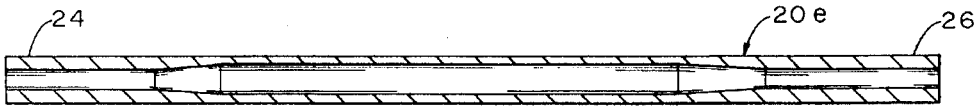

End butting is illustrated in FIGS. 1(*a*) to (*e*). In FIG. 1 (*a*) a drawn tube 20 is shown with a push dome 22 formed on one end. The tube is drawn (right to left in FIG. 1(*b*)) through a die 30 over a mandrel 32 having end regions smaller than the middle region such that the drawing operation reduces the tube O.D. but thickens the tube wall metal corresponding to the thinner end regions 33 of the mandrel. Because the mandrel is thicker in the central regions than at the end regions, it must be forcibly pulled from the tube which is restrained by restraint 36 in FIG. 1(*c*) which shows the mandrel being pulled from left to right. This withdrawal forces the metal at the withdrawal end (right end in FIG.

1(*c*)) outwardly which flares the end some as shown in FIGS. 1(*c*) and (*d*). The second butt end draw in FIG. 1(*d*) alleviates this by forcing the flared out metal back in to produce a tube of a substantially constant O.D. with thicker walls in the end regions 24 and 26 in FIG. 1(*e*). The die 36 in FIG. 1(*d*) can be slightly smaller than that in FIG. 1(*b*) and the mandrel 38 , can be slightly smaller in O.D. or more or less the same as the O.D. for the smaller end 33 of the mandrel 32 in FIG. 1(*b*).

The tube parts of the frame are positioned for welding. The welding operation is normally by the tungsten inert gas (TIG) process, a process that is known in the welding arts. In this process, an electric arc is conducted between a tungsten or other non-consumed electrode and the workpiece, and filler metal is then fed into the weld site. The welding can be by hand or possibly automated. If the welding is automated, it may be suitable to employ a consumable aluminum electrode (metal inert gas (MIG) process). Appropriate welding techniques and welding sequence can be beneficial in reducing distortion and producing a quality bicycle frame. Known welding alloys containing over 3% silicon, such as AA4043 and 4643, can be used as the weld filler alloy. Alloy 4043 contains about 4.5 to 6% Si (max Mg is 0.05%) and alloy 4643 contains about 3.6 to 4.6% Si and about 0.1 to 0.3% Mg. It can be preferred to use weld filler alloy containing over 0.05% Mg, more preferably 0.1% Mg or more, to reduce any tendency for the weld filler metal to draw Mg from the aluminum tube members.

Unless indicated otherwise, the following definitions apply herein:

a. The term "ksi" is equivalent to kilopounds (1000 pounds) per square inch.

b. Percentages for a composition refer to % by weight.

c. The term "ingot-derived" means solidified from liquid metal by a known or subsequently developed casting process rather than through powder metallurgy techniques. This term shall include, but not be limited to, direct chill casting, electromagnetic casting, spray casting and any variations thereof.

d. In stating a numerical range or a minimum or a maximum for an element of a composition or a temperature or other process matter or any other matter herein, and apart from and in addition to the customary rules for rounding off numbers, such is intended to specifically designate and disclose each number, including each fraction and/or decimal, (i) within and between the stated minimum and maximum for a range, or (ii) at and above a stated minimum, or (iii) at and below a stated maximum. (For example, a range of 1 to 10 discloses 1.1, 1.2 . . . 1.9, 2, 2.1,2.2 . . . and so on, up to 10, and a range of 500 to 1000 discloses 501,502 . . . and so on, up to 1000, including every number and fraction or decimal therewithin, and "up to 5" discloses 0.01 . . . 0.1 . . . 1 and so on up to 5.) Having described the presently preferred embodiments, it is to be understood that the invention may be otherwise embodied within the scope of the appended claims.

What is claimed is:

1. A method of producing an improved elongate hollow aluminum tubular product comprising:

providing an alloy consisting essentially of about 0.7% to 1.2% magnesium, about 0.4 to 1.2% silicon, about 0.6 to 1.2% copper, about 0.2 to 1% manganese, balance substantially aluminum and incidental elements and impurities;

extruding said alloy within about 500° to about 800° F. at an extrusion ratio of at least 5:1 into a hollow tube;

drawing said alloy to a reduction of at least 15% in metal cross section;

solution heat treating said alloy and then quenching; and artificial aging subsequent to said solution heat treating and quenching.

2. The method according to claim 1 wherein said extruding is within about 500° to about 675° F.

3. The method according to claim 1 wherein said extruding is within about 575° to about 650° F.

4. The method according to claim 1 wherein said solution heat treating includes heating to at least 1000° F.

5. The method according to claim 1 wherein the extrusion ratio is about 8 to 27:1.

6. The method according to claim 1 wherein the extrusion ratio is about 5 to 30:1.

7. The method according to claim 1 wherein said tube is cold worked after quenching.

8. The method according to claim 1 wherein said drawing reduction is at least 50%.

9. The method according to claim 1 wherein said drawing reduction is at least 70%.

10. The method according to claim 1 wherein said drawing includes more than one stage and the cumulative reduction in metal cross section is over 50%.

11. The method according to claim 10 wherein an intermediate anneal is used between two of said stages.

12. A method of producing an improved elongate hollow aluminum tubular product comprising:

providing an alloy consisting essentially of about 0.7% to 1.2% magnesium, about 0.4 to 1.2% silicon, about 0.6 to 1.2% copper, about 0.2 to 1% manganese, balance substantially aluminum and incidental elements and impurities;

extruding said alloy within about 500° to about 800° F. at an extrusion ratio of about 5 to 30 into a hollow tube;

cold drawing said alloy to a reduction of at least 15% in cross section;

solution heat treating said alloy at a temperature of at least about 1000° F. and then quenching; and artificial aging.

13. The method according to claim 12 wherein said alloy is cold worked after quenching and before artificial aging.

14. A method of producing an improved elongate hollow aluminum tubular product comprising:

providing an alloy consisting essentially of about 0.7% to 1.2% magnesium, about 0.4 to 1.2% silicon, about 0.6 to 1.2% copper, about 0.2 to 1% manganese, balance substantially aluminum and incidental elements and impurities;

extruding said alloy within about 500° to about 800° F. at an extrusion ratio of about 5 to 30:1 into a hollow tube;

drawing said alloy to a reduction of at least 15% in cross section into cold drawn tube;

solution heat treating said tube at a temperature of at least about 1000° F. and then quenching;

segmenting said tube into shorter lengths; and thickening the tube wall thickness at one or both end regions of at least some of said shorter tube lengths.

15. The method according to claim 14 wherein said extrusion is within about 550° to 675° F.

16. In the method of producing a bicycle frames wherein aluminum tube members are welded to other members, the improvement wherein at least some of said aluminum tubular members are made by a method comprising:

providing an alloy consisting essentially of about 0.7% to 1.2% magnesium, about 0.4 to 1.2% silicon, about 0.6 to 1.2% copper, about 0.2 to 1% manganese, balance substantially aluminum and incidental elements and impurities;

extruding said alloy within about 500° to about 800° F. into a hollow elongate extrusion;

drawing said alloy to a reduction of at least 15% in cross section into a drawn tube;

solution heat treating said tube and then quenching;

segmenting said tube into shorter lengths for said bicycle frames; and thickening the tube wall thickness at one or both end regions of said shorter tube lengths.

17. In the method of claim 16 wherein said extruding is within about 500° to about 675° F.

18. In the method of claim 16 wherein said extruding is within about 575° to about 650° F.

19. In the method of claim 16 wherein said solution heat treating includes heating to at least 1000° F.

20. In the method of claim 16 wherein the extrusion ratio is about 5 to 30:1.

21. In the method of claim 16 wherein said tube is cold worked after quenching.

22. In the method of claim 16 wherein said tube is artificially aged.

23. In the method of claim 16 wherein said tube is cold worked after quenching.

24. In the method of claim 16 wherein at least some of said aluminum tube members in said bicycle frame are joined by welding.

25. In the method according to claim 16 wherein after quenching said tube or a portion thereof has the tube wall thickness thickened at one or both end region thereof.

26. In the method of producing a bicycle frame wherein aluminum tube members are joined to other members, at least one of said tube members having a thicker tube wall in one or both end regions thereof, the improvement wherein at least some of said aluminum tubular members are made by a method comprising:

providing an alloy consisting essentially of about 0.7% to 1.2% magnesium, about 0.4 to 1.2% silicon, about 0.6 to 1.2% copper, about 0.2 to 1% manganese, balance substantially aluminum and incidental elements and impurities;

extruding said alloy within about 500° to about 800° F. into a hollow elongate tube;

drawing said alloy to a reduction of at least 15% in metal cross section;

solution heat treating said alloy at a temperature of at least about 1000° F. and then quenching;

further cold working said tubing; and artificial aging.

27. The method according to claim 26 wherein said joining includes welding.

28. The method according to claim 26 wherein said joining includes adhesive bonding.

29. The method according to claim 26 wherein said drawing includes more than one stage and the cumulative reduction in metal cross section is over 50%.

30. The method according to claim 26 wherein said drawing includes more than one stage and the cumulative reduction in metal cross section is over 70%.

31. The method according to claim 26 wherein said drawing includes more than one stage and the cumulative reduction in metal cross section is over 40%.

32. In the method of producing a bicycle frame wherein aluminum tube members are welded to other members, the improvement wherein at least some of said aluminum tube members are made by a method comprising:

providing an alloy consisting essentially of about 0.7% to 1.2% magnesium, about 0.4 to 1.2% silicon, about 0.6 to 1.2% copper, about 0.2 to 1% manganese, balance substantially aluminum and incidental elements and impurities;

extruding said alloy within about 500° to about 800° F. into a hollow elongate tube;

drawing said alloy to a reduction of at least 15% in metal cross section;

solution heat treating said alloy at a temperature of at least about 1000° F. and then quenching; and artificial aging subsequent to said solution heat treating and quenching.

33. In the method of producing a bicycle frame wherein aluminum tube members are welded together, the improvement wherein at least some of said aluminum tubular members are made by a method comprising:

providing an alloy consisting essentially of about 0.7% to 1.2% magnesium, about 0.4 to 1.2% silicon, about 0.6 to 1.2% copper, about 0.2 to 1% manganese, balance substantially aluminum and incidental elements and impurities;

extruding said alloy into a hollow elongate extrusion;

drawing said alloy to a reduction of at least 15% in metal cross section into a drawn tube;

solution heat treating said alloy at a temperature of at least about 1010° F. and then quenching; and thickening the end region tube wall of one or both ends of a tube length suited for said frame.

34. A bicycle frame comprising cold drawn aluminum alloy tube members welded to make a frame or subframe, at least a plurality of said aluminum tube members comprising aluminum alloy consisting essentially of about 0.7 to 1.2% magnesium, about 0.4 to 1.2% silicon, about 0.6 to 1.2% copper, about 0.2 to 1% manganese, balance substantially aluminum and incidental elements and impurities, said bicycle frame being artificially aged.

35. A bicycle frame comprising cold drawn aluminum alloy tube members welded to make a frame or subframe, at least a plurality of said aluminum tube members having at least one end region with a thicker wall than a region further spaced from the end region and comprising aluminum alloy consisting essentially of about 0.7% to 1.2% magnesium, about 0.4 to 1.2% silicon, about 0.6 to 1.2% copper, about 0.2 to 1% manganese, balance substantially aluminum and incidental elements and impurities, said bicycle frame being artificially aged.

36. A method of making a bicycle frame comprising:

(a) providing tube stock of an alloy consisting essentially of about 0.7% to 1.2% magnesium, about 0.4 to 1.2% silicon, about 0.6 to 1.2% copper, about 0.2 to 1% manganese, balance substantially aluminum and incidental elements and impurities, the production of said tube including extruding into a hollow elongate tube and thereafter drawing to a reduction of at least 15% in metal cross section; and thereafter (b) solution heat treating said tube at at least about 1010° F. and then quenching;

(c) assembling a bicycle frame or subframe including at least one tube made from said tube stock, said assembly including welding;

(d) solution heat treating said bicycle frame or subframe below the temperature in (b) and below 1020° F. and then cooling.

37. The method according to claim 36 wherein said solution heat treating for said tube in (b) is at at least 1020° F.

38. The method according to claim 36 wherein said extruding is within about 500° to about 800° F.

39. The method according to claim 36 wherein the extrusion ratio is about 5 to 30:1.

40. The method according to claim 36 wherein said tube is cold worked after quenching.

41. The method according to claim 36 wherein said drawing reduction is at least 50%.

42. The method according to claim 36 wherein said drawing includes more than one stage and the cumulative reduction in metal cross section is over 50%.

43. A method of making a bicycle frame comprising:

(a) providing tube stock of an alloy consisting essentially of about 0.7% to 1.2% magnesium, about 0.4 to 1.2% silicon, about 0.6 to 1.2% copper, about 0.2 to 1% manganese, balance substantially aluminum and incidental elements and impurities, the production of said tube including extruding within about 500° to about 800° F. into a hollow elongate tube and thereafter drawing to a reduction of at least 15% in metal cross section;

(b) solution heat treating said tube stock at at least about 1010° F. and then rapidly quenching;

(c) assembling a bicycle frame or subframe including at least one tube made from said tube stock, said tube having at least one end region with a thicker wall than a region further spaced from the end region, said assembly including welding;

(d) solution heat treating said bicycle frame below 1020° F. and then quenching at a quench rate slower than the aforesaid rapidly quenching.

44. The method according to claim 43 wherein said drawing reduction is at least 40%.

45. The method according to claim 43 wherein the extrusion ratio in said extruding is at least 5.

46. The method according to claim 43 wherein said solution heat treating of said tube is at at least 1020° F,

47. The method according to claim 43 wherein said assembly of said bicycle frame includes welding said tube with an aluminum base weld filler alloy containing over 3% Si.

48. The method according to claim 43 wherein said assembly of said bicycle frame includes welding said tube with an aluminum base weld filler alloy containing over 0.05% Mg.

49. A method of making a bicycle frame comprising:

(a) providing tube stock of an alloy consisting essentially of about 0.7% to 1.2% magnesium, about 0.4 to 1.2% silicon, about 0.6 to 1.2% copper, about 0.2 to 1% manganese, balance substantially aluminum and incidental elements and impurities, the production of said tube including extruding into a hollow elongate tube and thereafter drawing to a reduction of at least 15% in metal cross section; and thereafter (b) solution heat treating at at least about 1010° F. and then cold water quenching;

(c) assembling a bicycle frame or subframe including at least one tube made from said tube stock, said assembly including welding with a weld filler alloy containing more than 3% Si and more than 0.05% Mg;

(d) rapidly solution heat treating said bicycle frame below 1020° F. and below the temperature in (b) and then quenching at a rate slower than a drastic cold water quench rate.

50. The method according to claim 49 wherein said solution heat treating of said tube in (b) is at or above 1020° F.

51. The method according to claim 49 wherein said tube made from said tube stock has at least one end region with a thicker wall than a region further spaced from the end region.

* * * * *